US009781523B2

(12) United States Patent
Kuster et al.

(10) Patent No.: US 9,781,523 B2
(45) Date of Patent: Oct. 3, 2017

(54) HEARING INSTRUMENT

(75) Inventors: Martin Kuster, Oetwil am See (CH); Alfred Stirnemann, Zollikon (CH); Axel Schlesinger, Stafa (CH)

(73) Assignee: Sonova AG, Stäfa (CH)

( * ) Notice: Subject to any disclaimer, the term of this patent is extended or adjusted under 35 U.S.C. 154(b) by 467 days.

(21) Appl. No.: 14/110,953

(22) PCT Filed: Apr. 14, 2011

(86) PCT No.: PCT/CH2011/000082

§ 371 (c)(1),
(2), (4) Date: Nov. 21, 2013

(87) PCT Pub. No.: WO2012/139230

PCT Pub. Date: Oct. 18, 2012

(65) Prior Publication Data

US 2014/0079260 A1 Mar. 20, 2014

(51) Int. Cl.
*H04R 25/00* (2006.01)
*H04R 1/32* (2006.01)
*H04R 29/00* (2006.01)

(52) U.S. Cl.
CPC ..... *H04R 25/405* (2013.01); *H04R 1/326* (2013.01); *H04R 29/006* (2013.01)

(58) Field of Classification Search
CPC ..... H04R 1/32–1/46; H04R 3/00–3/14; H04R 25/00–25/75; H04R 29/00–29/008; H04R 2225/00–2225/83; H04R 25/405; H04R 1/326; H04R 29/006; H04R 25/407
USPC ..... 381/23.1, 312, 313, 328, 355, 357, 380, 381/381, 382, 356, 111, 68, 92, 122, 369, 381/375, 155
See application file for complete search history.

(56) References Cited

U.S. PATENT DOCUMENTS 2,552,878 A * 5/1951 Wiggins ..... H04R 1/38 381/173
3,875,349 A * 4/1975 Ruegg ..... H03F 3/183 381/123
5,524,056 A * 6/1996 Killion ..... H04R 25/407 381/309
5,878,147 A 3/1999 Killion et al.
6,075,869 A 6/2000 Killion et al.
(Continued)

FOREIGN PATENT DOCUMENTS

CH 533408 3/1973
EP 0652686 5/1995
(Continued)

OTHER PUBLICATIONS

Fa-Long Luo et al. "Adaptive Null-Forming Scheme in Digital Hearing Aids", IEEE Transactions on Signal Processing, Jul. 2002, vol. 50, No. 7, pp. 1583-1590, 8 pages.

*Primary Examiner* — Md S Elahee
*Assistant Examiner* — Angelica M McKinney
(74) *Attorney, Agent, or Firm* — Sonova AG

(57) ABSTRACT

A hearing instrument microphone device incudes at least two microphone sound ports (or sound inlets), a pressure difference microphone in communication with at least two of the sound ports and a pressure microphone in communication with at least one of the sound ports, wherein the acoustic centers of the pressure difference microphone and the pressure microphone essentially coincide.

10 Claims, 4 Drawing Sheets

(56) References Cited

U.S. PATENT DOCUMENTS

| | | | | |
|---|---|---|---|---|
| 6,603,861 | B1 * | 8/2003 | Maisano | H04R 25/407 381/122 |
| 2002/0071583 | A1 * | 6/2002 | Stetzler | H04R 25/405 381/316 |
| 2003/0142836 | A1 | 7/2003 | Warren et al. | |
| 2008/0253596 | A1 * | 10/2008 | Klinkby | H04R 25/407 381/313 |
| 2011/0044460 | A1 | 2/2011 | Rung | |
| 2014/0112509 | A1 * | 4/2014 | Lafort et al. | 381/322 |
| 2014/0169601 | A1 * | 6/2014 | Pedersen | 381/316 |

FOREIGN PATENT DOCUMENTS

| | | | | |
|---|---|---|---|---|
| EP | 2107823 | | 10/2009 | |
| WO | 01/95666 | | 12/2001 | |
| WO | WO 01/95666 | * | 12/2001 | H04R 3/00 |
| WO | WO 0195666 A2 | * | 12/2001 | H04R 1/326 |

* cited by examiner

HEARING INSTRUMENT

BACKGROUND OF THE INVENTION

Field of the Invention

The invention relates to a hearing instrument, in particular a hearing aid.

Description of Related Art

Static or adaptive beamforming is a beneficial technique available in a hearing aid to help the wearer in challenging listening situations. Typically beamforming is achieved electronically by combining the signals from two omni-directional microphones (which are sensitive to acoustic pressure) or by using a single-membrane directional microphone having two sound ports. EP 0 652 686 discloses several variants of adaptive microphone arrays and methods of processing their signals.

Beamforming based on two omni-directional microphones is based on the directionally dependent phase difference between the two microphones and assumes that they are identical in magnitude and phase response. This feature has the disadvantage that the signal combination is sensitively dependent on the characteristics of the two microphones, which in reality are unavoidably slightly different due to manufacturing tolerances. For example, the tension of the microphone membranes or the size and geometry of an opening for the static pressure equalization may slightly vary from microphone to microphone. This requires a delicate post manufacturing adjustment process or adaptive matching during operational use, and brings about a residual inaccuracy. Overall, the matching requirement is a substantial obstacle in further product development and advancement.

In addition to adaptive beamforming, the prior art also teaches hearing instruments that can be switched between an omnidirectional mode in which the processed sound signal is taken from an omnidirectional microphone and a directional mode in which a directional microphone, such as a pressure gradient microphone, is used. CH 533 408, U.S. Pat. No. 5,808,147 and EP 2 107 823 teach examples of microphone arrangements in which a pressure microphone (omnidirectional microphone) and a pressure gradient or hypercardioid microphone (directional microphone) are integrated in a common casing. Solutions with switchable directivity between omni and a given pre-determined directivity require a manual or signal-dependent switching mechanism and cannot offer the full benefit of an adaptive beamformer.

BRIEF SUMMARY OF THE INVENTION

It is an object of the invention to provide microphone devices and hearing instruments that are alternatives to the known combination of two omnidirectional microphones and allow for good static and/or adaptive beamforming performance without the need for magnitude and phase matching of two microphones. Embodiments should not merely be switchable between an omni and pre-determined directional but make fully adjustable directivity possible.

In accordance with a first aspect of the invention, a hearing instrument microphone device, in particular a hearing aid microphone device, is provided, the microphone device comprising at least two microphone sound ports (or sound inlets), a (pressure) difference microphone in communication with at least two of the sound ports and a pressure microphone (or pressure average microphone) in communication with at least one of the sound ports, wherein the acoustic centers of the pressure difference microphone and the pressure microphone essentially coincide.

A difference microphone or pressure difference is often referred to as 'pressure gradient' microphone even though at short wavelength the pressure difference is only an approximate measure for the pressure gradient, which approximation is the more inappropriate the smaller the wavelength. A pressure average microphone, if connected to a plurality of ports by tubings, is sensitive of an average pressure incident on the plurality of ports. If the tubings are of unequal lengths, the pressure measured is still an average, but not (necessarily) an arithmetic average. If a pressure average microphone is connected to a single port, it measures the pressure incident on said port. In the following, we generally refer to a "pressure" microphone, this term including embodiments in which the measured pressure is an arithmetic or non-arithmetic average of pressures incident on different ports. Such a (average) pressure microphone is sometimes referred to as "omnidirectional" microphone, because in an approximation it does not show any directional dependency.

It is an insight of the present invention that signals of a pressure microphone and a pressure difference microphone with common acoustic center can be combined to yield a direction dependent signal with a desired, for example adjustable direction dependency—for example in an adaptive configuration. As an example, the directional dependency may be adaptively controlled in reaction to background noise and/or focusing parameters set by the user. Because the acoustic centers coincide, the directional response between the two microphones varies only in magnitude—as given by their respective directivity—but not in phase.

In a group of embodiments, the pressure difference microphone and the pressure microphone are arranged in a common microphone casing.

The acoustic centers of the microphone are essentially determined by the microphone device sound ports with which the microphones are coupled. The acoustic center of a transducer initially is the location where the acoustic energy is converted into mechanical and then electrical energy. For a microphone of the described kind, this is initially the center of the membrane. However, in case of a tubing, the effective acoustic center—that is relevant in the present context—is in essence an equivalent acoustic center that takes into account that the sound propagation through the tubings corresponds to a directionally-independent delay that is well-defined for both microphones and that is therefore defined by the sound ports.

In many embodiments, the acoustic center of a microphone coupled to one microphone port may be viewed as the location of the port, whereas the acoustic center of a microphone coupled to two microphone ports is approximately the center point between the two ports.

This leads to an alternative definition according to which a center of the locations of the sound port openings in communication with the pressure microphone has to be located on the perpendicular bisector of the locations of the sound port openings of the pressure difference microphone, i.e. the center of the locations of the sound port openings in communication with the pressure microphone has to be at equal distances from the (two) sound port openings of the pressure difference microphone.

The sound ports in many embodiments correspond to openings in the hearing instrument casing. In these, the hearing instrument casing around the sound port defines a casing plane. Advantageously, in addition to the above-defined condition, the center of the locations of the pressure microphone sound port openings is essentially on or near the shortest line along the casing that connects the two pressure difference sound port openings. In other words, the center of the locations of the pressure microphone sound port openings is preferably not (or not to much) shifted sideways in relation to the pressure difference microphone sound port openings. For example, such a side shift away from the shortest connecting line is at most 3 mm, even more preferred at most 2 mm.

In many embodiments, but not necessarily, the center points of the port(s) coupled to the pressure microphone and of the ports coupled to the pressure difference microphone coincide.

The pressure difference microphone may comprise a pressure difference microphone cartridge with a membrane dividing the volume within the cartridge in two volume parts, the first volume part being, via a first opening (and for example a tubing), coupled to a first one of the ports, whereas the second volume part is, via a second opening (and for example a tubing), coupled to a second one of the ports.

The pressure microphone may be a pressure microphone comprising a pressure microphone cartridge, and a membrane dividing the cartridge volume in two volume parts, the first volume part being, via at least one pressure microphone opening, coupled to at least one of the ports, whereas the second volume part is closed.

In the embodiments in which the pressure microphone and the pressure difference microphone are arranged in a common casing, the cartridges of these two microphones may be arranged so that the two membranes are parallel. For example, the microphone device casing may comprise a common outer box and a separation wall dividing the volume within the common outer box into the two cartridge volumes in each of which one of the membranes are arranged, for example parallel to each other.

In a first group of embodiments, the pressure difference microphone and the pressure microphone are both coupled to the same plurality of ports. For example, the microphone device may have two ports, and both, the pressure difference microphone and the pressure microphone may be coupled to the two ports. This means that in contrast to prior art combinations of different microphones, the pressure microphone is open to both ports of the pressure difference microphone.

In a second, alternative group of embodiments, the pressure microphone and the pressure difference microphone are coupled to different ports, the condition being fulfilled that the acoustic center of the microphones being coupled to the ports essentially coincide, especially in accordance with the hereinbefore described definitions. For example, a single port of the pressure microphone may be located at the (acoustic) center of the two ports of the pressure difference microphone, the acoustic center of two ports coupled to the pressure microphone may coincide with the acoustic center of two separate ports coupled to the pressure difference microphone.

The above-stated condition for the locations of the sound port openings is for example met if a potential residual offset from this condition is so small that for the signal processing and beamforming accuracy demanded in a hearing aid no direction dependent electronic delay compensation is required. In some embodiments, this is achieved if the acoustic center of the pressure microphone sound ports is not more than about 2 mm, 1.5 mm or 1 mm away from the perpendicular bisector of the locations of the pressure difference microphone sound port openings, depending on the desired accuracy. Especially, the condition is met if the equivalent pressure microphone and pressure difference microphone acoustic centers are mismatched by a maximum of about 2 mm, 1.5 mm or 1 mm.

In embodiments of the second group, the microphone device comprises two ports coupled, by a tubing, to two different sound inlet openings of the pressure difference microphone and arranged laterally with respect to the pressure difference microphone cartridge and further comprises a central port coupled to a sound inlet opening of the omnidirectional microphone or formed thereby. In other embodiments of the second group, the pressure microphone and the pressure difference microphone each comprise two ports, the ports of the pressure difference microphone being located peripherally, and the ports of the pressure microphone preferably being located closer to the common acoustic center. Also configurations with more than two ports coupled to a microphone are possible.

A hearing instrument according to the first aspect comprises a microphone device of the above and hereinafter described kind and further comprises a signal processor and, optionally, if it is a classical hearing aid, a receiver. The signal processor is capable of processing the signals produced by the microphones in response to an incident acoustic signal and, if applicable, of activating the receiver to convert an electronic output signal produced by the signal processor into an acoustic output signal. The signal processor is capable of applying a correction filter to at least one of the pressure microphone signal and the pressure difference microphone signal, and of combining these signals into a processed signal with a pre-defined or adjustable directional dependency.

The beamformer may be an adaptive beamformer. Alternatively, the beamformer may have a static directivity.

The correction filter may be a static correction filter. It has been found that a static correction filter is capable of correcting the directionally independent different frequency responses of the two microphones. In other words, it is generally sufficient if the correction filter is a static correction filter that accounts for the differences in the frequency responses between the pressure microphone and the pressure difference microphone.

The signal processor may, but does not need to be, physically a single processor. Optionally, it may be formed by a single physical microprocessor or other monolithic electronic device. Alternatively, the signal processor may comprise a plurality of signal processing elements communicating with each other.

Especially, the processor may be capable of carrying out an adaptive beamforming process with the pressure microphone signal and the pressure difference microphone signal as input signals.

According to a second aspect of the invention, a hearing instrument, in particular a hearing aid, is provided, the hearing instrument comprising a pressure difference microphone and a pressure microphone, and a signal processor. The signal processor is capable of obtaining a first digital input signal representative of a sound signal incident on the pressure microphone and a second digital input signal representative of a sound signal incident on the pressure difference microphone, and of processing the first and second signals into an output signal (that, in classical hearing instruments, is fed to at least one receiver. The signal processor comprises a correction filter adjusting a frequency dependency of at least one of the first and the second output signals into an adjusted first or second input signal, respectively; and a beamformer capable of combining the adjusted first and second signals onto a beamformed signal with an adjustable directional dependency.

Again, the signal processor may but does not need to be a single physical entity.

Again, the beamformer may be an adaptive beamformer or have a static directivity. Also, the correction filter may be a static correction filter.

The second aspect of the invention uses the new insight that instead of combining signals of pressure microphones, a beamformed signal can be obtained by combining the signals of a pressure microphone and of a pressure difference microphone—even though these two kinds of microphones are based on different physical principles.

Preferably, in embodiments of the second aspect of the invention, at least one of the following conditions is fulfilled:

the above defined condition that holds for the acoustic centers of a microphone device according to the first aspect is fulfilled; and an electronic delay compensation is established to compensate for a sound path difference of sound incident on the directional microphone and of sound incident on the pressure microphone.

This makes possible that the pressure and the directional input signals may be combined to obtain a common directional characteristic.

Especially, the pressure microphone and the pressure difference microphone may belong to a microphone device according to any embodiment of the first aspect of the invention.

In embodiments, the adaptive beamformer may comprise a static directional characteristic shaping stage that combines the adjusted first and second signals into two combined direction dependent signals in accordance with predefined, static rules, and an adaptive beamforming stage that calculates, dependent on a desired directional characteristic, a beamformed output signal. The combined direction dependent signals may for example be cardioids.

The term "hearing instrument" or "hearing device", as understood in this text, denotes on the one hand classical hearing aid devices that are therapeutic devices improving the hearing ability of individuals, primarily according to diagnostic results. Such classical hearing aid devices may be Behind-The-Ear (BTE) hearing aid devices or In-The-Ear (ITE) hearing aid devices (including the so called In-The-Canal (ITC) and Completely-In-The-Canal (CIC) hearing aid devices and comprise, in addition to at least one microphone and a signal processor and/or, amplifier also a receiver that creates an acoustic signal to impinge on the eardrum. The term "hearing instrument" however also refers to implanted or partially implanted devices with an output side impinging directly on organs of the middle ear or the inner ear, such as middle ear implants and cochlear implants.

Further, the term also stands for devices that may improve the hearing of individuals with normal hearing by being inserted—at least in part—directly in the ears of the individual, e.g. in specific acoustical situations as in a very noisy environment.

BRIEF DESCRIPTION OF THE DRAWINGS

In the following, embodiments of the invention are described referring to drawings. In the drawings, same reference numerals refer to same or analogous elements. The drawings are all schematic. They show.

DETAILED DESCRIPTION OF THE INVENTION

Figure 1:
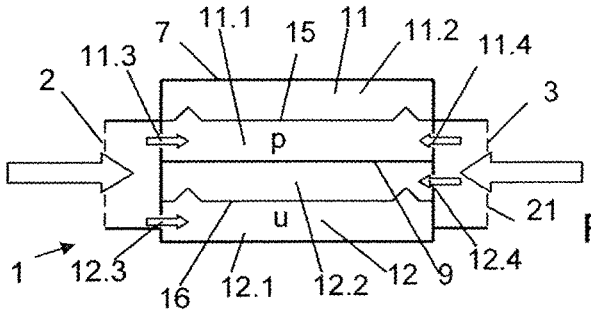
FIG. 1 is a schematic representation of a first embodiment of a microphone device according to the first aspect of the invention.

The microphone device 1 depicted in FIG. 1 is a basic version illustrating the operating principle. The microphone device comprises a first port 2 and a second port 3, the ports being arranged at a distance from each other. In the depicted configuration with no tubing, the sound ports are formed by spouts of the microphone device.

In a common casing 7, a pressure microphone 11 and a pressure difference microphone 12 are arranged.

The pressure microphone 11 is formed by a pressure microphone cartridge and comprises a membrane 15 that divides the cartridge in a first volume 11.1 and a second volume 11.2. The first volume 11.1 is coupled, via sound inlet openings 11.3, 11.4 of the cartridge, to the first and second ports, respectively, whereas the second volume 11.2 is closed. The pressure microphone, as is known in the art, due to its construction is not sensitive to the direction of incident sound.

The pressure difference microphone 12 is formed by a pressure microphone cartridge and comprises a membrane 16 that divides the cartridge in a first volume 12.1 and a second volume 12.2. The first volume 12.1 is coupled via a first sound inlet opening 12.3 of the cartridge, to the first port 2, and the second volume 12.2 is coupled, via a second sound inlet opening 12.4 of the cartridge, to the second port 3. Due to this construction, the pressure difference microphone 12 is sensitive to the sound direction in that a sound signal sound incident from directions parallel to the line that connects the first and second spouts 2, 3 lead to a signal different in magnitude than a sound signal incident of equal strength from a direction approximately perpendicular to this line. The directional dependency of pressure difference microphone sound sensitivity is known in the art and will not be explained in any more detail here.

A remarkable property of the embodiment of FIG. 1, compared to prior art combinations of different microphones, is that the pressure microphone is open to both ports. As a consequence, the acoustic centers of the pressure microphone and of the pressure difference microphone coincide.

In the depicted configuration, the pressure microphone cartridge and the pressure difference microphone cartridge are both formed by the common casing 7 and an additional rigid separating wall 9 that divides the casing volume between the two cartridges. This construction, however, is not a requirement. Rather, other geometries are possible, the sizes and/or shapes of the cartridges and/or the orientation of the membranes need not been equal, and/or between the pressure microphone cartridge and the pressure difference microphone cartridge, other objects may be arranged.

The ports 2, 3, in all embodiments, may further comprise a protection 21, for example of the kind known in the field.

Figure 2:
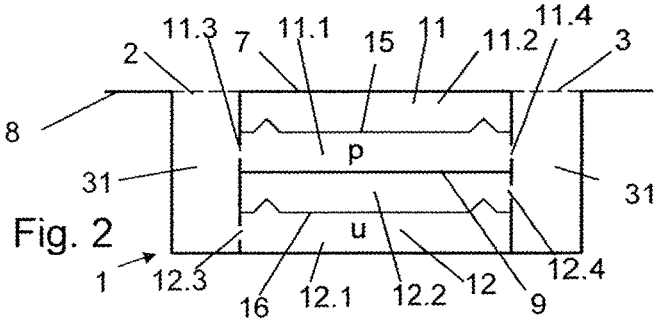
FIGS. 2-8 are schematic representations of alternative embodiments of microphone devices according to the first aspect of the invention, and partly how they are integrated in a hearing instrument casing.

FIG. 2 depicts an embodiment that is similar to the configuration of FIG. 1 but in which both ports are open not towards opposing lateral sides but towards a front side (towards the top in the depicted configuration). For example the microphone device 1 may be placed in a hearing instrument, and the ports 2, 3 may be small openings in the hearing instrument casing 8. The sound conducting volumes that connect the ports with the respective openings may be viewed as tubing 31 or ducts from the ports 2, 3 to the respective openings 11.3, 11.4, 12.3, 12.4, the word 'tubing' not being meant to restrict the material or geometry of the sound conducting duct from the ports to the sound inlet openings. In other words, in all embodiments, the tubing may comprise flexible tubes or rigid ducts or have any other configuration that allows for a communication between the ports and the sound inlet openings of the microphones.

In the embodiment of FIG. 2 as well as in the subsequently depicted embodiments, the microphone device may optionally comprise spouts at the locations of the sound inlet openings, to which the tubings may be connected. Separate spouts may be present for the different openings, or, as in FIG. 1, the spouts may be common to neighbored openings.

The directional dependency of the sound sensitivity of the pressure difference microphone 12, especially for lower frequencies, is improved if the ports 2, 3 are arranged at some distance to each other. Therefore, in a variant of the embodiment of FIG. 2, the ports may be arranged not in immediate vicinity to the microphone casing 7 as in FIG. 2, but at a larger laterals distance thereto, with the tubing connecting the ports to the sound inlet openings.

Figure 3:
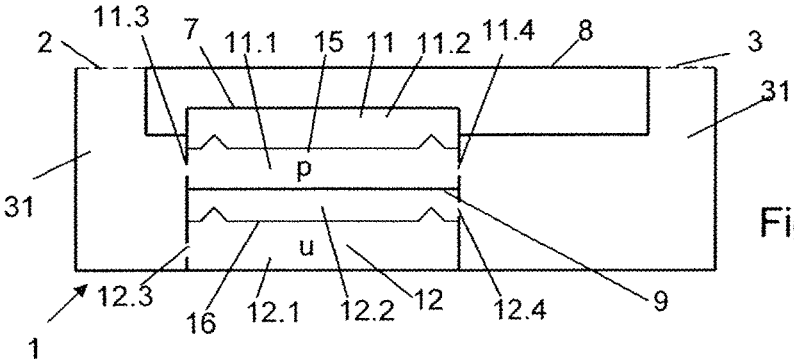

FIG. 3 depicts a further embodiment, in which the tubing 31 is asymmetrical. The asymmetry in tubing lengths requires unequal front and back volumes for the pressure difference microphone.

A further difference between the embodiment of FIG. 3 and the one depicted in FIG. 2 is that the microphone casing 7 is offset relative to the hearing instrument casing 8 towards the hearing instrument interior; i.e. the microphone casing does not form part of the hearing instrument casing but is arranged in an interior of the hearing instrument. This further difference is independent of the asymmetrical arrangement, and both modifications can apply to any embodiment. I.e., a hearing instrument according to any embodiment can have an offset casing without an asymmetrical tubing of the microphone device or can have an asymmetrical tubing of the microphone device without the offset casing—and of course can have both or neither.

Figure 4:
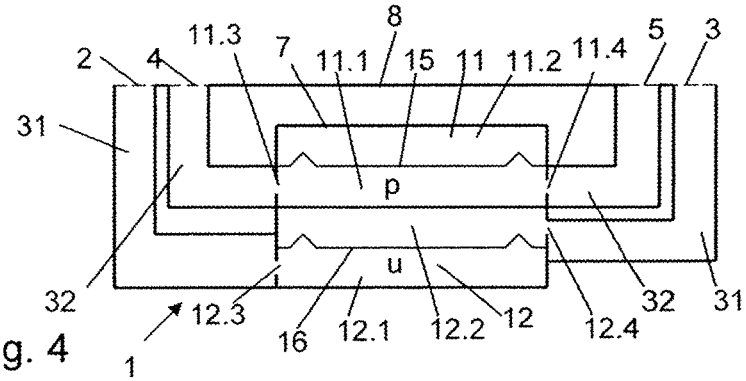

FIG. 4 shows an embodiment in which the pressure difference microphone and the 12 pressure microphone 11 have separate tubings 31, 32, respectively, and separate ports 2, 3; 4, 5, respectively. Especially, in the depicted configuration, the ports 2, 3 of the pressure difference microphone are spaced from each other further than the ports 4, 5 of the pressure microphone. Nevertheless, the center points of the two pairs of ports and hence the acoustic centers of the two microphones coincide. In alternative embodiments, the spacing of the ports of the pressure microphone could be larger than the spacing of the ports of the pressure difference microphone, even though a large spacing of the pressure difference microphone ports is potentially advantageous.

In the embodiments of FIG. 4 as well as in other embodiments, the sound path lengths through the tubing from the port to the pressure microphone and the pressure difference microphone, respectively, are unequal. In such embodiments, the signal processor that processes the signals generated by the two microphones preferably applies a delay on the signal with the shorter tubing length (the pressure microphone signal in the embodiments of FIGS. 4, 5 and others) to compensate. Such a delay, however, as long as the condition of the first aspect of the invention is fulfilled, is not dependent on the direction of incidence and therefore not delicate.

Figure 5:
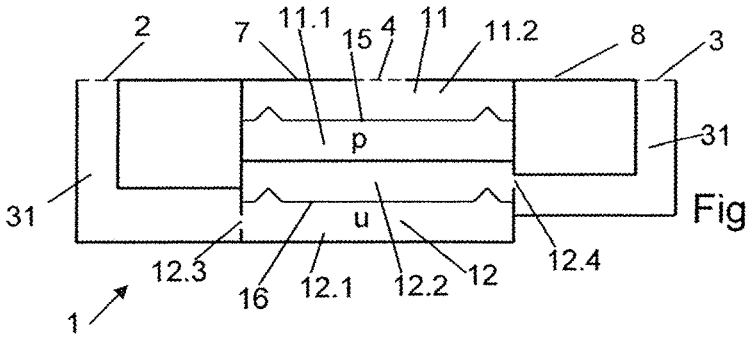

Also in the variant of FIG. 5, the pressure microphone 11 and the pressure difference microphone 12 have separate ports. In this variant, however, the pressure microphone has a single, central port 4. The single central port is located at the place of the acoustic center of the two ports 2, 3 of the pressure difference microphone.

Figure 6:
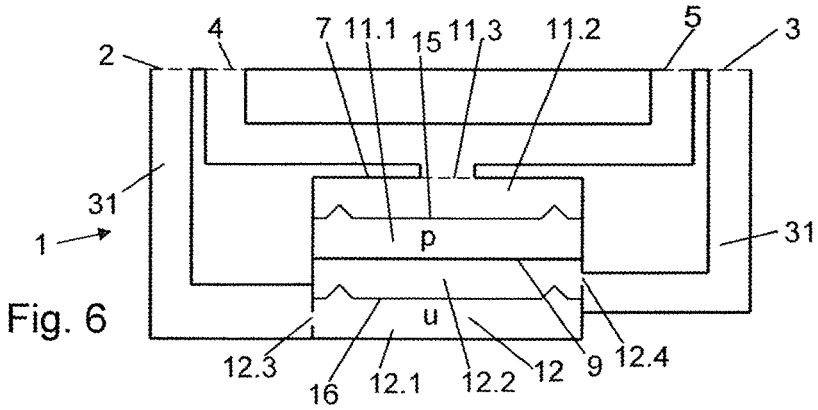

In the embodiment of FIG. 6, the microphone device comprises separate tubings 31, 32 and ports 2, 3, 4, 5 for the pressure difference microphone and the pressure microphone. A single sound inlet opening 11.3 of the pressure microphone is coupled to two tubings and thus in acoustic communication with two ports 4, 5.

Figure 7:
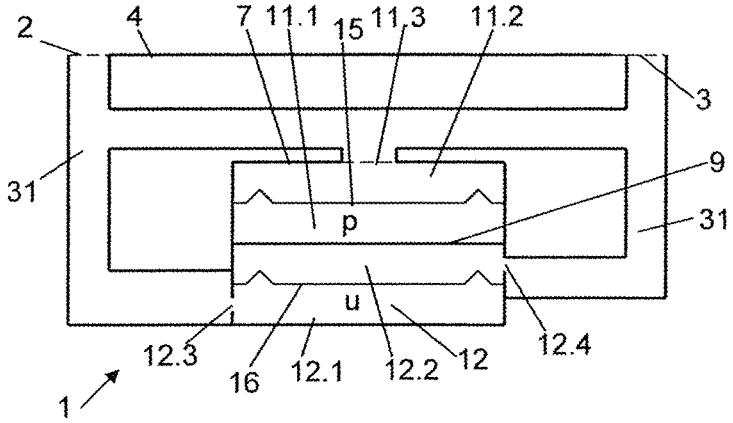

The embodiment of FIG. 7 is a variant of the embodiment of FIG. 6. The single sound inlet opening 11.3 of the pressure microphone is coupled to (is in acoustic communication with) two tubings 31 and hence the ports 2, 3 of the pressure difference microphone.

Figure 8:
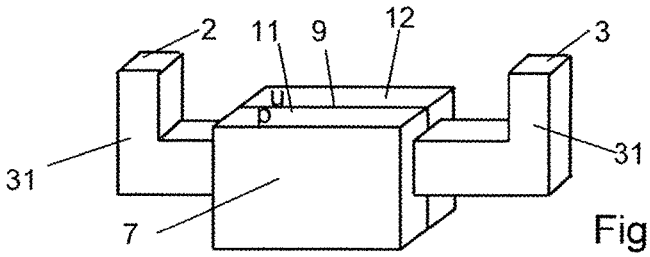

In all embodiments, including in all of the embodiments illustrated herein in FIGS. 2-7, it is possible to arrange the pressure microphone and the pressure difference microphone so that the two membranes 15, 16 are placed next to each other instead of on top of each other with respect to the direction to which the ports face. The membranes 15, 16 are then in a 'vertical' plane instead of in a 'horizontal' plane (=plane parallel to the hearing instrument casing plate under which the microphone is arranged and in which the ports are present). This is very schematically illustrated in FIG. 8. The membranes are, in the shown configuration, parallel to the drawing plane instead of perpendicular thereto as in the previous embodiments.

Figure 9:
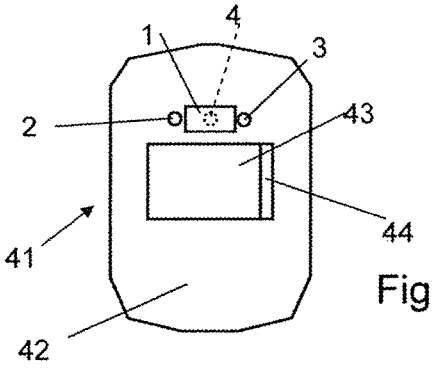
FIG. 9 is a schematic representation of a hearing instrument.

FIG. 9 yet very schematically depicts a hearing instrument 41. More in particular, the outward facing faceplate 42 of a Completely-in-the-Canal (CIC) hearing instrument can be seen in FIG. 9, with the battery compartment cover 43 and its hinge 44 being visible. The microphone device 1 may be arranged next to the battery compartment, for example integrated in the molded faceplate 41 or arranged as a separate component immediately beneath the faceplate. In alternative configurations (not depicted), the microphone device may also be arranged along the short side of the battery compartment, optionally with an additional, central port 4 integrated in the hinge or behind it. In all configurations, very compact solutions can be possible.

As an alternative to being a CIC hearing instrument, the hearing instrument comprising the microphone device 1 according to any embodiment may be an other in-the-ear (ITE) hearing instrument, or may be a behind-the-ear (BTE) hearing instrument. In some prior art BTE hearing instruments, the two sound inlet ports of the two pressure microphones by which adaptive beam forming is achieved are located on both sides of a push-button or other device. Such configurations—with the microphones located deeply in the hearing instrument—are also possible with the herein described microphone devices. However, often it is advantageous to locate the microphones close to the outer plate of the casing to keep the tubings short. In this case, the pushbutton or other device may be arranged side-by-side with the microphone device. More in general, the microphone device may be located anywhere in the hearing instruments, and the ports may be placed at any convenient position of the hearing instrument, including embodiments the ports are directly embodiments of the hearing instrument shell and embodiments where ports are arranged in or under other elements such as a volume control, a hinge of a cover, a pushbutton etc.

As is known in the field, the hearing instrument further comprises a receiver, a signal processor and means—that may be integrated in the signal processor or separate therefrom—to digitally capture a signal generated by the microphones in response to an acoustic signal and to activate a receiver to send an acoustic output signal in response.

Figure 10:
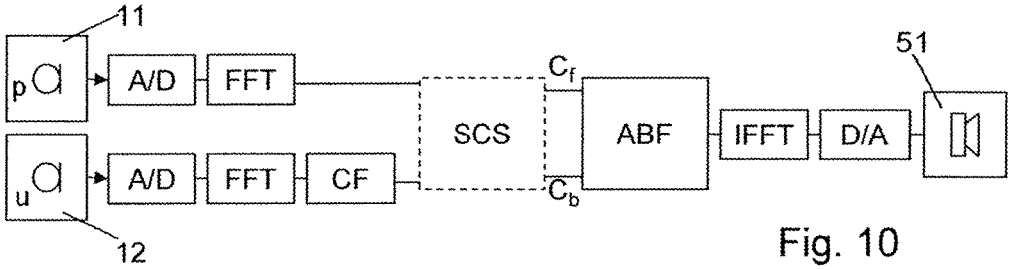
FIGS. 10 and 11 are block diagrams of possibilities of processing signals in hearing instruments according to the first or second aspect.

FIG. 10 shows a block diagram of the processing taking place in the hearing instrument. The signals produced by the pressure microphone 11 and by the pressure difference microphone 12 are both converted into digital signals (A/D) and then preferably transferred into the frequency domain (for example by Fast Fourier Transform FFT). Then, a correction filter (CF) is applied to at least one of the pressure microphone signal (p) and of the pressure difference microphone signal (u). In the depicted configuration, a filter is applied to the pressure difference microphone signal. The correction filter may be a static correction filter, i.e. a filter with a set frequency dependence. The purpose of the correction filter is to adjust the signals for different frequency responses of the pressure microphone and of the pressure difference microphone. The filter characteristics may be determined by measurements and/or calculations.

Figure 12:
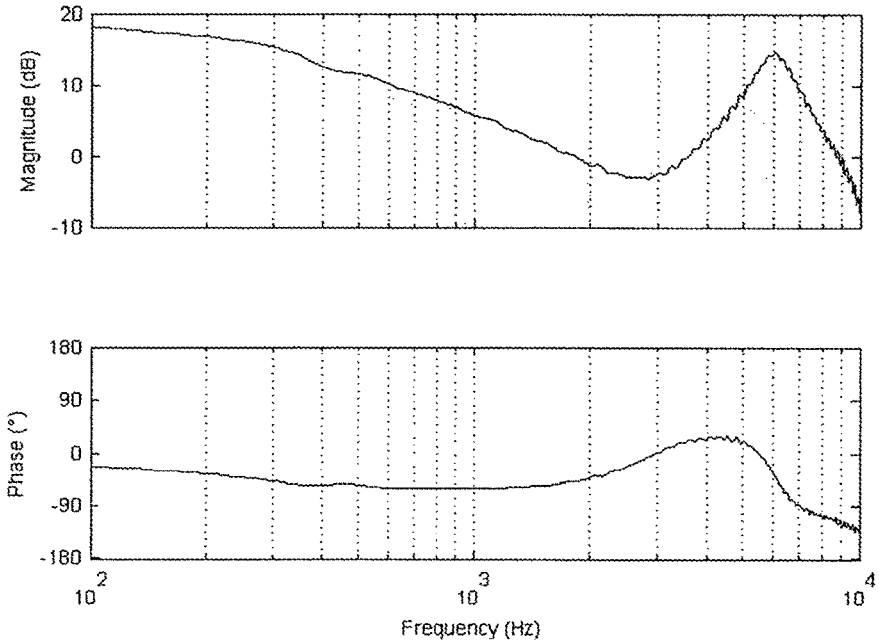
FIG. 12 is a graph of the frequency response (magnitude and phase) of a static correction filter of an embodiment.

An example of a filter characteristics is shown in FIG. 12, where the top panel shows the measured magnitude of and the bottom panel the measured phase of a static correction filter. The dip at 3 kHz is due to a resonance of the used embodiment of the pressure difference microphone, whereas the peak at 6 kHz is due to a resonance of the used embodiment of the used pressure microphone.

Figure 11:
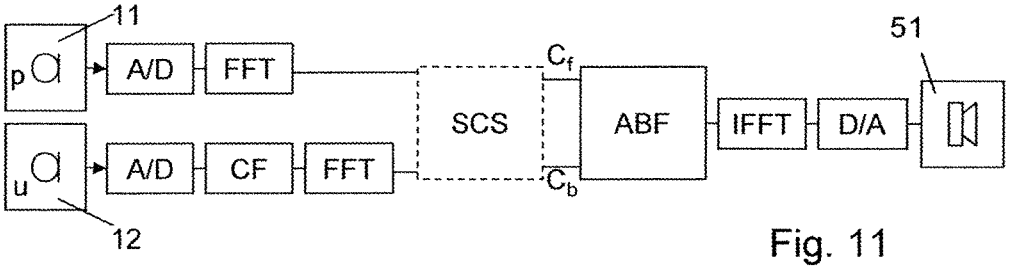

The correction filter is generally arranged before the signals of the pressure and pressure difference microphones are combined. In contrast to the configuration of FIG. 10, this can also be done prior to the conversion in the frequency domain (as shown in FIG. 11) or even prior to the analog-to-digital conversion, the latter by means of an analog filter.

The combination of the signals can comprise a step of static cardioid shaping SCS. From the Front Cardioid ($C_r$) and the Back Cardioid ($C_b$), a beamformed signal may be obtained, i.e. the directional dependence of the sensitivity may adaptively be adjusted. Adaptive beamforming from two static cardioids is known in the field of signal processing in hearing instruments and will not be detailed any further here.

Instead of first calculating cardioids, the (in one case corrected) p and u signals may be directly used as input quantities for the adaptive beamforming, hence the static cardioid shaping is optional.

After the beamforming and optionally further processing steps, the signal is transferred back to the time domain (IFFT) and then used to activate a receiver 51, possibly after a digital-to-analog (D/A) conversion step (approaches without an explicit D/A step, for example with pulsewidth modulated signals are also possible).

In the above-described embodiments of microphone devices, the pressure microphone and the pressure difference microphone are always arranged on top of each other or side by side. This is often advantageous but not necessary. Rather the microphones may be independently arranged.

Also, in the described embodiments, the centers of the membranes both located on the same plane parallel to the perpendicular bisector of the locations of the sound port openings of the pressure difference microphone. Also this may be advantageous but is not a necessity, rather arrangements where the microphones are arranged 'side by side' or in an other configuration are possible, as long as the condition is met.

Further, while in the depicted embodiments the membranes are parallel (this sometimes being advantageous because of easier implementation) this is not necessary. Rather, the membranes may be at an angle with respect to each other, for example 90°. Especially, in the configuration of FIG. 8, one of the microphones may be turned by 90° compared to the depicted variant.

Finally, the effective, equivalent acoustic centers of the pressure microphone and the pressure difference microphone in the above embodiments generally coincide. However, this is not a necessity. Rather, the acoustic centers may be offset with respect to each other as long as the condition is essentially met. For example, the centers may be offset with respect to each other in a vertical direction (perpendicular to the casing surface plane) if the casing has according features at its surface. Also, the centers may be slightly shifted sideways with respect to each other, as discussed above.

Figure 13:
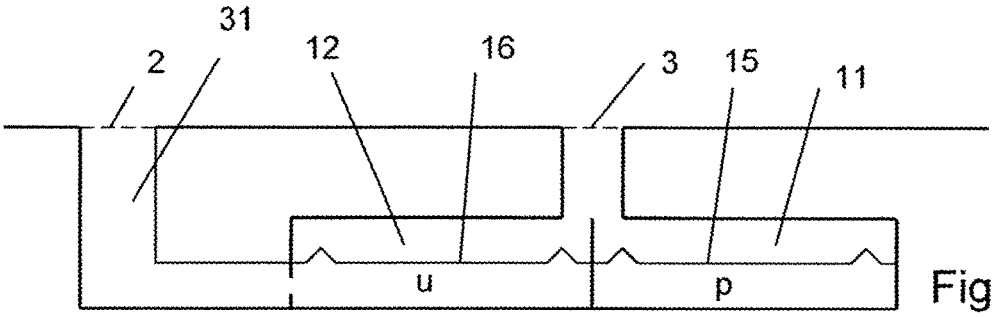
FIG. 13 is a schematic representation of a microphone device, not according to the first aspect, that may be used in embodiments of hearing aids of the second aspect of the invention.

FIG. 13 yet depicts a microphone device 1 that is not according to the first aspect of the invention in that the acoustic centers of the pressure microphone 11 and of the pressure difference microphone 12 do not coincide. In the depicted configuration, the pressure microphone and the pressure difference microphone share a common port 3, whereas an other port 2 is coupled to a sound inlet opening of the pressure difference microphone only.

When the signals of the microphones 11, 12 of FIG. 13 are combined for beamforming, the signal processing has to include electronic delay compensation prior to combination to account for the different locations of the acoustic centers of the two microphones.

What is claimed is:

1. A hearing instrument including a signal processor, a receiver, and a microphone device, the microphone device comprising:

at least two microphone ports, a pressure difference microphone in communication with at least two of the ports, a pressure microphone in communication with at least one of the ports and having an effective acoustic center, wherein the effective acoustic center of the pressure microphone is the center point of the ports that are in communication with the pressure microphone, wherein the effective acoustic center of the pressure microphone is essentially at equal distances from locations of the ports in communication with the pressure difference microphone, and wherein the signal processor comprises a first input channel and a second input channel, and is capable of obtaining a first digital input signal representative of an acoustic signal incident on the pressure microphone via the first input channel, and a second digital input signal representative of an acoustic signal incident on the pressure difference microphone via the second input channel, processing the first and second digital input signals, combining the first and second digital input signals into a processed signal with an adjustable directional dependency, and activating the receiver to convert an electronic output signal produced by the signal processor into an acoustic output signal.

2. The hearing instrument according to claim 1, wherein the pressure microphone and the pressure difference microphone are arranged in a common casing.

3. The hearing instrument according to claim 1, wherein the pressure difference microphone comprise a pressure difference microphone cartridge with a membrane dividing the volume within the cartridge in two volume parts, the first volume part being, via a first opening of the pressure difference microphone, coupled to a first one of the ports, whereas the second volume part is, via a second opening of the pressure difference microphone, coupled to a second one of the ports.

4. The hearing instrument according to claim 1, wherein the pressure microphone is a pressure microphone comprising a pressure microphone cartridge, and a membrane dividing the cartridge volume in two volume parts, the first volume part being, via at least one pressure microphone opening, coupled to at least one of the ports, whereas the second volume part is closed.

5. The hearing instrument according to claim 1, wherein membranes of the pressure microphone and of the pressure difference microphone are parallel.

6. The hearing instrument according to claim 1, wherein the pressure difference microphone and the pressure microphone are both coupled to the same plurality of ports.

7. The hearing instrument according to claim 1, wherein the pressure difference microphone is coupled to two pressure difference microphone ports and wherein the pressure microphone is coupled to at least one pressure microphone port separate from the pressure difference microphone ports.

8. The hearing instrument according to claim 1, wherein the signal processor is capable of applying a correction filter to at least one of the first digital input signal and the second digital input signal, prior to combining the signals.

9. The hearing instrument according to claim 1, wherein the signal processor comprises:

a correction filter adjusting a frequency dependency of at least one of the first and the second input signals into adjusted first or second input signals, respectively, and a beamformer capable of combining the adjusted first and second input signals onto a beamformed signal with an adjustable directional dependency.

10. The hearing instrument according to claim 9, wherein the beamformer is an adaptive beamformer.

* * * * *